US006918374B1

(12) United States Patent
Kurita et al.

(10) Patent No.: US 6,918,374 B1
(45) Date of Patent: Jul. 19, 2005

(54) INTAKE AIR AMOUNT CONTROL APPARATUS FOR AN ENGINE

(75) Inventors: Kazuhisa Kurita, Tokyo (JP); Kenji Nakao, Tokyo (JP); Yoshihiko Onishi, Tokyo (JP); Shigenobu Tochiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/986,876

(22) Filed: Nov. 15, 2004

(30) Foreign Application Priority Data

Jul. 2, 2004 (JP) ..... 2004-196938

(51) Int. Cl.[7] ..... F02D 9/10
(52) U.S. Cl. ..... 123/396; 123/399; 123/337
(58) Field of Search ..... 123/396, 399, 123/337, 361

(56) References Cited

U.S. PATENT DOCUMENTS 4,625,943 A * 12/1986 Groger ..... 251/305
5,429,090 A * 7/1995 Kotchi et al. ..... 123/396
5,996,551 A * 12/1999 Schroder ..... 123/337
6,240,899 B1 * 6/2001 Yamada et al. ..... 123/396
6,263,898 B1 * 7/2001 Vanderveen et al. ..... 137/15.25
6,834,639 B2 * 12/2004 Torii ..... 123/399
6,840,217 B2 * 1/2005 Meiwes et al. ..... 123/396
2004/0261766 A1 * 12/2004 Matsuda et al. ..... 123/399

FOREIGN PATENT DOCUMENTS

JP 2-500677 A 3/1990
JP 2003-120335 A 4/2003

* cited by examiner

*Primary Examiner*—Erick Solis
(74) *Attorney, Agent, or Firm*—Sughrue Mion, PLLC

(57) ABSTRACT

An intake air amount control apparatus for an engine is capable of stabilizing the controllability of a valve (10) as well as reducing the number of component parts required. A coil spring (11) includes a first spring portion (11*a*) having a first end portion (12), a second spring portion (11*b*) having a second end portion (13), a joint portion (19) that connects the first spring portion (11*a*) and the second spring portion (11*b*) with each other. The first end portion (12) of the first spring portion (11*a*) and the second end portion (13) of the second spring portion (11*b*) are attached to a body (9) through a movable member (14), and the joint portion (19) is attached to a final spur gear (4).

8 Claims, 9 Drawing Sheets

INTAKE AIR AMOUNT CONTROL APPARATUS FOR AN ENGINE

BACKGROUND OF THE INVENTION

1. Field of the Invention

The present invention relates to an intake air amount control apparatus for an engine capable of electrically driving the degree of opening of a valve, and more specifically, it relates to an intake air amount control apparatus for an engine having a function to hold the degree of opening of a valve at a predetermined degree of intermediate opening slightly greater than an idle opening when a drive motor becomes inoperable due to malfunctions such as a conduction defect, etc.

2. Description of the Related Art

In the past, there has been known an intake air amount control apparatus for an engine in which two springs, including a first coiled torsion spring for urging a valve in an intake passage toward a valve opening side and a second coiled torsion spring for urging the valve toward a valve closing side, are used to hold the valve at a predetermined degree of intermediate opening (for example, see a first patent document: Japanese patent application laid-open No. 2-500677, FIG. 1).

However, the known intake air amount control apparatus for an engine as described in the above-mentioned first patent document has the following problems. That is, two springs for urging the valve toward the intermediate opening are required, thus increasing the number of component parts, and the controllability of the valve in its movement from its intermediate opening position toward the closing side or the opening side becomes unstable due to variation in the characteristics of the individual springs.

SUMMARY OF THE INVENTION

Accordingly, the present invention is intended to obviate the above-mentioned problems, and has for its object to obtain an intake air amount control apparatus for an engine which is capable of stabilizing the controllability of a valve as well as reducing the number of component parts required.

Bearing the above object in mind, according to the present invention, there is provided an intake air amount control apparatus for an engine, including: a body having an intake passage formed therein; a shaft being disposed across the intake passage and rotatable with respect to the body; a valve fixedly mounted on the shaft for adjusting the degree of opening in the intake passage through a rotational angle thereof; a gear fixedly secured to the shaft for transmitting torque in a direction to open the valve from a drive motor to the shaft; and a torsion coil spring urging the valve in a direction to close the valve. The torsion coil spring includes a first spring portion having a first end portion, a second spring portion having a second end portion, a joint portion that connects the first spring portion and the second spring portion with each other. The first end portion of the first spring portion and the second end portion of the second spring portion are attached directly or indirectly to the body, with the joint portion being attached to the gear.

According to the intake air amount control apparatus for an engine as described above of the present invention, the controllability of the valve can be stabilized, and at the same time the number of component parts can be reduced.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
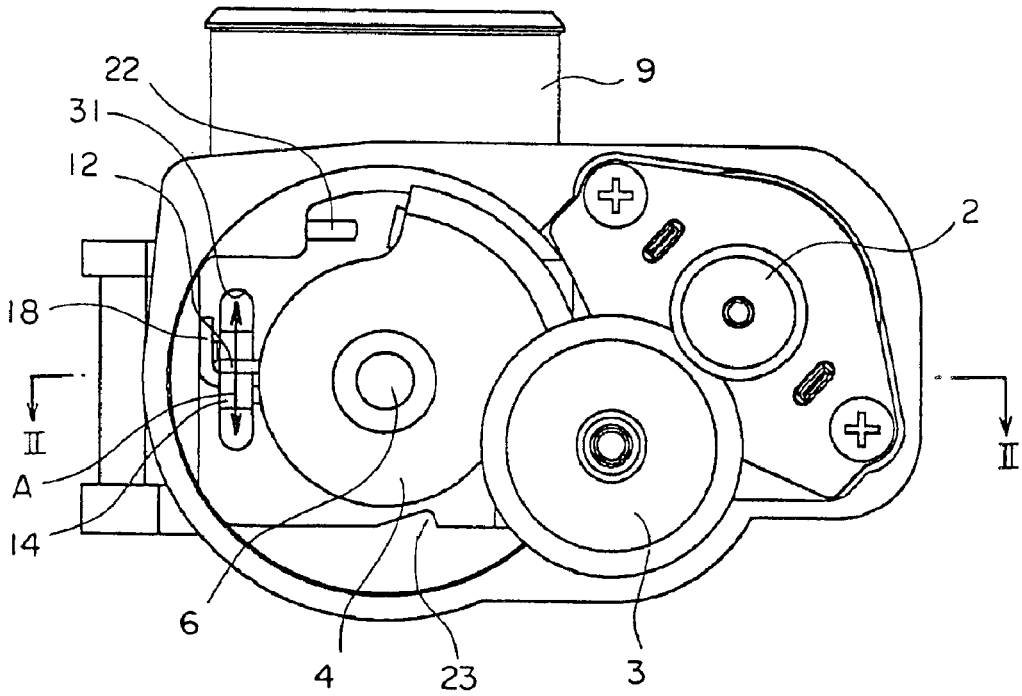
FIG. 1 is a front elevational view showing an intake air amount control apparatus for an engine according to a first embodiment of the present invention.

Now, preferred embodiments of the present invention will be described in detail while referring to the accompanying drawings. Throughout the following embodiments of the present invention, the same or corresponding members or parts are identified by the same reference numerals and characters.

Embodiment 1.

Hereinafter, reference will be first made to an intake air control apparatus for an engine (hereinafter referred to simply as an intake air control apparatus) according to a first embodiment of the present invention.

Figure 2:
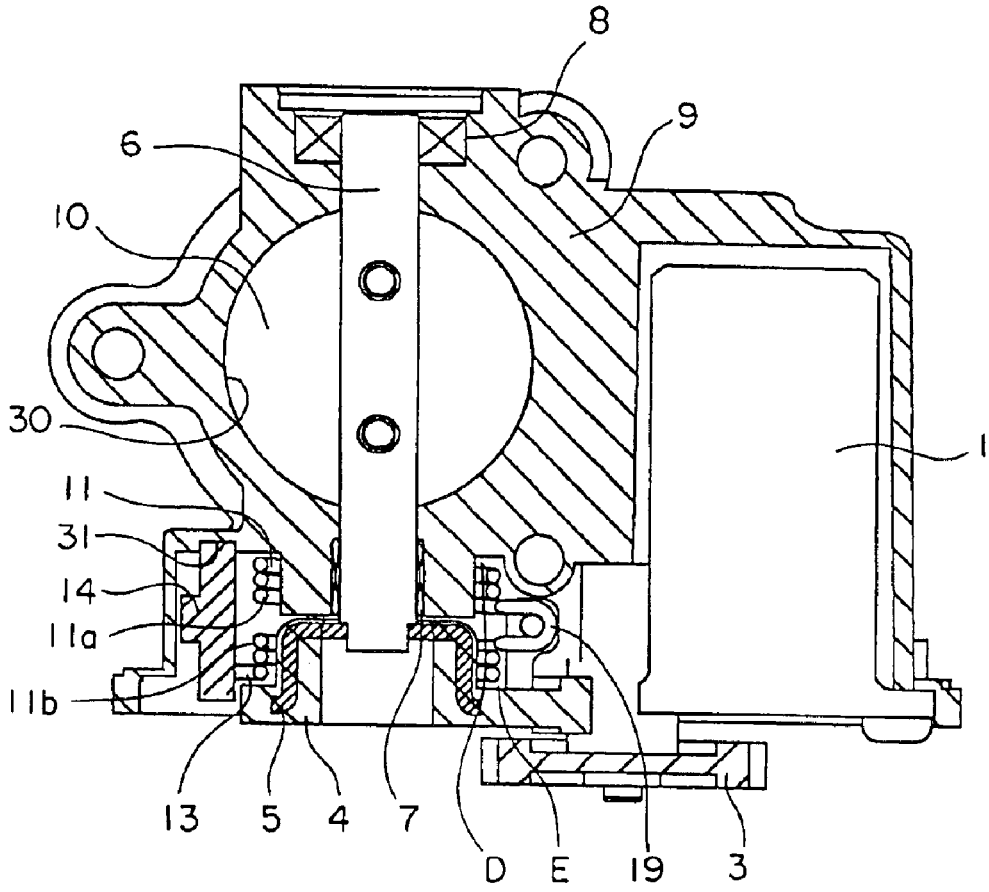
FIG. 2 is a cross sectional arrow view along line II—II in FIG. 1.

FIG. 1 is a front elevational view of this intake air amount control apparatus, and FIG. 2 is a cross sectional arrow view along line II—II in FIG. 1.

In the intake air control apparatus according to this embodiment, a motor spur gear 2 is fixedly mounted on a rotation or output shaft 2 of a drive motor 1 which is driven to rotate by direct current supplied thereto from an electric power supply (not shown). The motor spur gear 2 is in meshing engagement with an intermediate gear 3 made of resin, which is in turn in meshing engagement with a sector-shaped final spur gear 4 made of resin. A bottomed cylindrical plate 5 made of steel is embedded in the final spur gear 4. A shaft 6 has one end thereof extending through and fixedly attached to the final spur gear 4. The shaft 6 is rotatably supported through a first bearing 7 and a second bearing 8 on a body 9 that has an intake passage 30 formed therein. A valve 10 for adjusting the flow rate of air passing in the intake passage 30 is mounted on an intermediate portion of the shaft 6 by means of screws.

A torsion coil spring 11 (hereinafter abbreviated as a spring) is arranged on a side of the shaft 6 near the final spur gear 4 in a manner as to surround the shaft 6.

Figure 3:
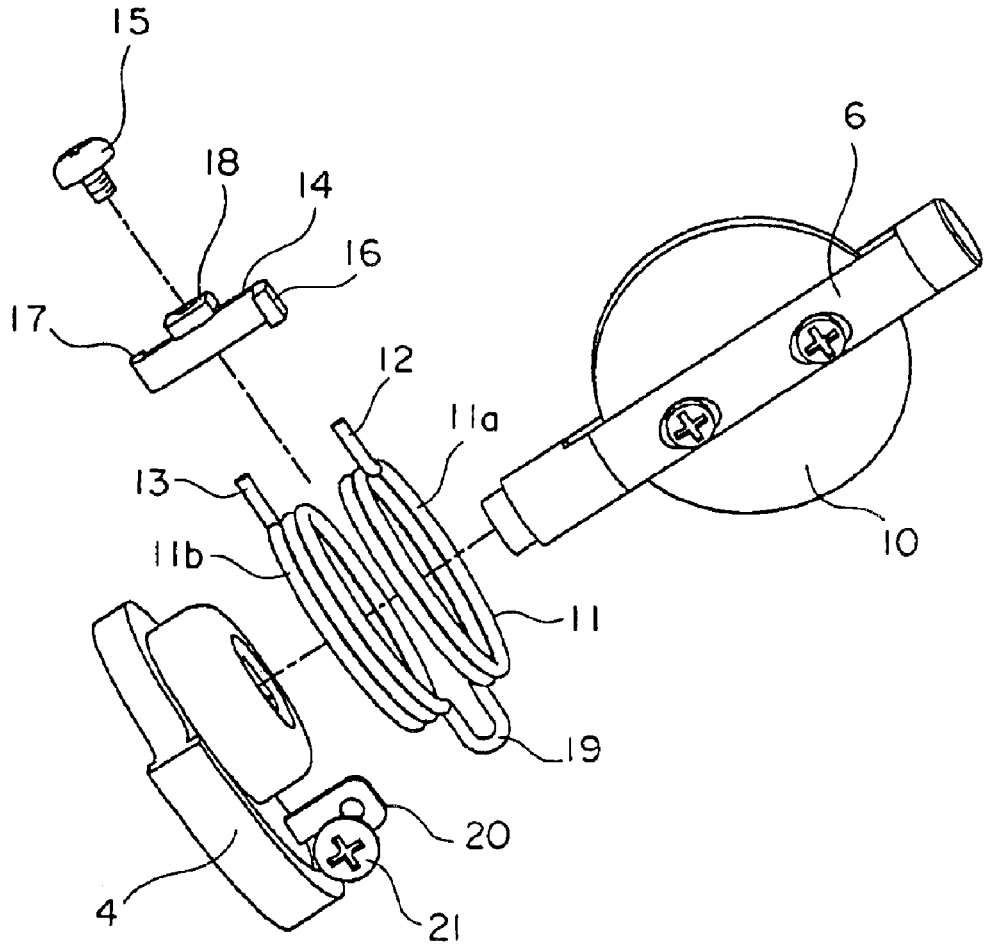
FIG. 3 is an exploded perspective view of the essential portions of the intake air amount control apparatus for an engine in FIG. 1.
Figure 4:
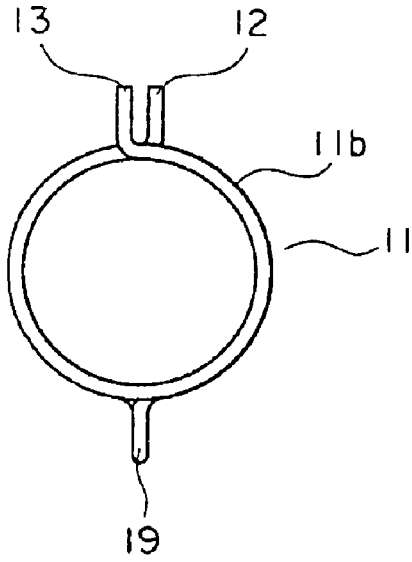
FIG. 4 is a front elevational view showing a torsion coil spring in FIG. 1.
Figure 5:
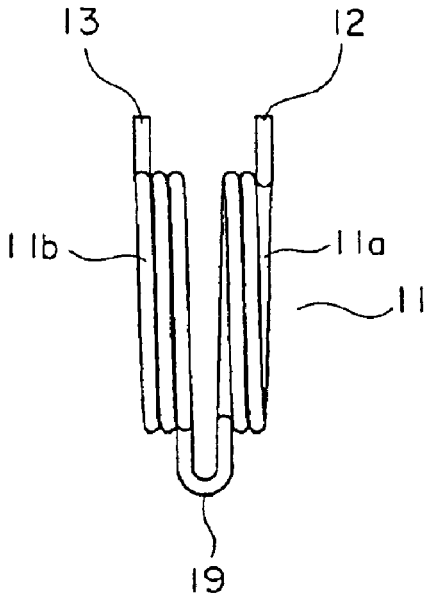
FIG. 5 is a left side elevational view showing the torsion coil spring in FIG. 4.

As shown in FIGS. 3 through 5, the torsion coil spring 11 includes a first spring portion 11*a* having a first end portion 12, a second spring portion 11*b* having a second end portion 13, and a U-shaped joint portion 19 that joins or connects the first spring portion 11*a* and the second spring portion 11*b* with each other. The first end portion 12 of the first spring portion 11*a* and the second end portion 13 of the second spring portion 11*b* are arranged to extend in the same direction.

The first end portion 12 is engaged with a hook 16 formed at one end of a movable member 14, and the second end portion 13 is engaged with a hook 17 formed at the other end of the movable member 14.

Figure 6:
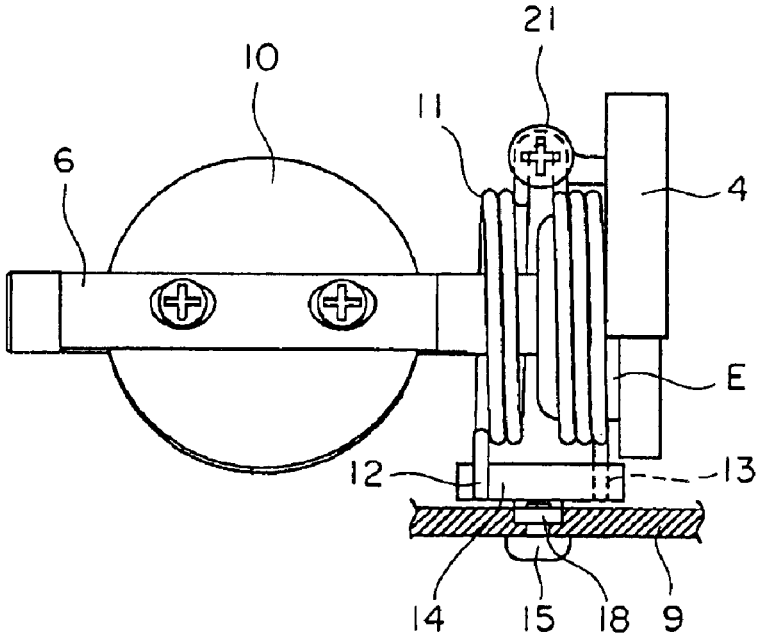
FIG. 6 is a side elevational view showing the essential portions of the intake air amount control apparatus for an engine in FIG. 1.
Figure 7:
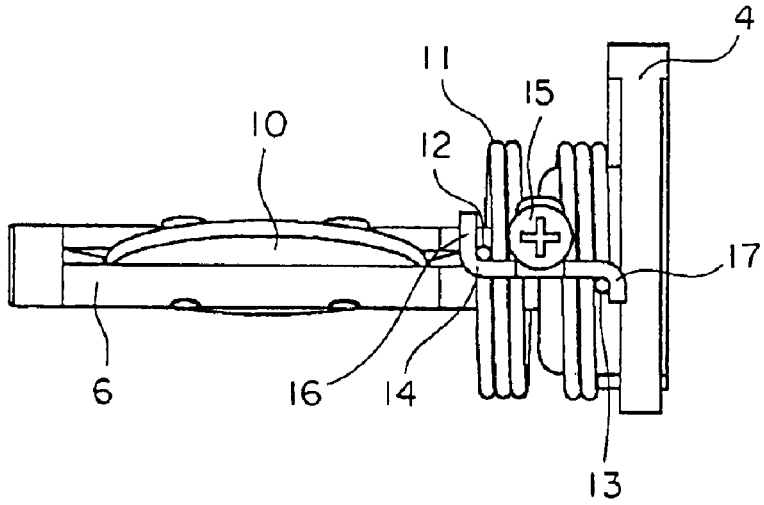
FIG. 7 is a view of the essential portions of the intake air amount control apparatus for an engine shown in FIG. 6 as seen from a body side.

The movable member 14 is formed at its intermediate portion with an L-shaped attachment portion 18. A fastening element in the form of a fastening screw 15 passes through the attachment portion 18, and the movable member 14 is fixedly attached to the body 9 through the fastening screw 15, as shown in FIG. 6. Here, note that FIG. 7 is a view when FIG. 6 is seen from the body 9, with the body 9 being omitted from FIG. 7.

As shown in FIG. 1 and FIG. 2, the body 9 has an adjustment groove 31 formed in a rotational tangential direction of the shaft 6, and the movable member 14 is slidable in and along the adjustment groove 31. The movable member 14 is able to move in the adjustment groove 31 within a range, indicated by arrow A in FIG. 1, so as to adjust the degree of intermediate opening of the valve 10.

The final spur gear 4 is provided with a protruded portion 20 that extends vertically with respect to the surface of the final spur gear 4, as shown in FIG. 3. The U-shaped joint portion 19 of the spring 11 is arranged and clamped between the protruded portion 20 and the head of a fastening screw 21 that serves as a fastening element, and the fastening screw 21 is threaded into the protruded portion 20, thereby fixedly attaching the joint portion 19 of the spring 11 to the final spur gear 4.

The first end portion 12 of the first spring portion 11*a* and the second end portion 13 of the second spring portion 11*b* are attached to the body 9 through the movable member 14, and the joint portion 19 is fixedly secured to the final spur gear 4. On the other hand, a first gap D is formed between a bearing surface of the first spring portion 11*a* and the body 9, and a second gap E is formed between a bearing surface of the second spring portion 11*b* and the final spur gear 4.

In the intake air control apparatus as constructed above, when the driver depresses an accelerator pedal, a signal representative of the degree of opening (i.e., the amount of depression) of the accelerator pedal is input from an accelerator opening sensor (not shown) to an unillustrated engine control unit (hereinafter referred to as "ECU"). The ECU serves to control the supply of electric power to the drive motor 1 so that the output shaft of the drive motor 1 is thereby driven to rotate so as to adjust the valve 10 to a predetermined degree of opening. In accordance with the rotation of the output shaft of the drive motor 1, the intermediate gear 3 and the final spur gear 4 are caused to rotate against an urging force of the spring 11, which serves to return the valve 10 to the degree of intermediate opening, whereby the shaft 6 formed integral with the final spur gear 4 is driven to rotate. Then, the valve 10 is held at a position at which the force from the drive motor 1 acting in a direction to open the valve 10 and the urging force of the spring 11 returning the valve 10 in a direction toward the degree of intermediate opening become balanced with each other.

Figure 8:
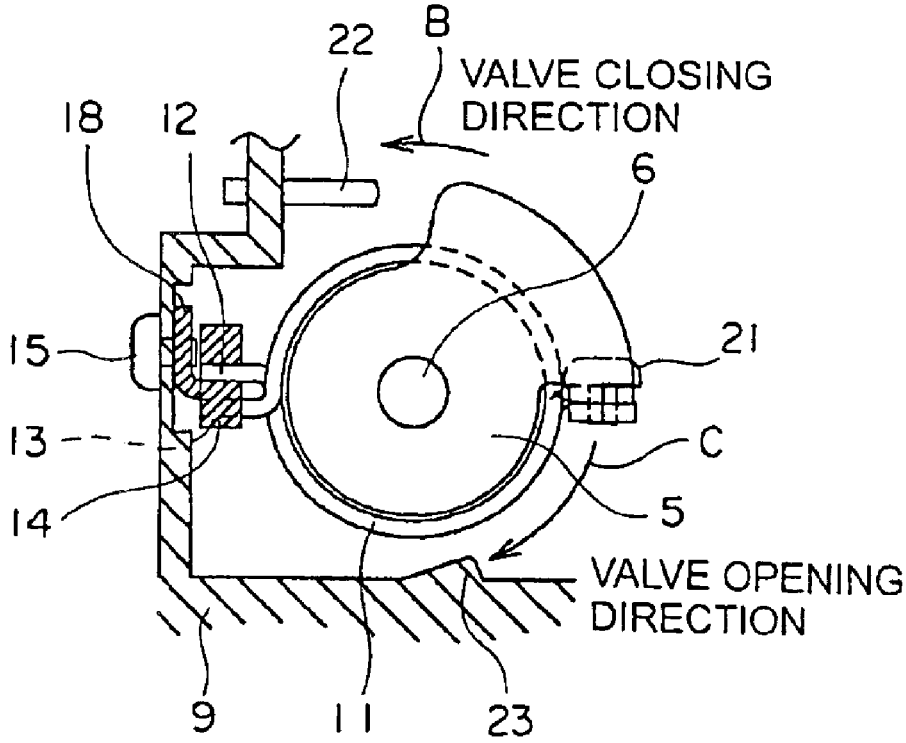
FIG. 8 is a view explaining the rotational operation of a final spur gear in FIG. 1.

In addition, as can be seen from FIG. 8 (a resin serving as an outer covering of the final spur gear 4 is removed so as to let the spring 11 appear), when the final spur gear 4 is driven to rotate in a direction of arrow B, i.e., when the valve 10 is driven to rotate in the fully closing direction, the final spur gear 4 is placed into abutment against a fully closed side stopper 22 provided on the body 9, thereby preventing further rotation of the valve 10. On the other hand, when the final spur gear 4 is driven to rotate in a direction of arrow C, i.e., when the valve 10 is driven to rotate in the fully opening direction, the final spur gear 4 is placed into abutment against a fully opened side stopper 23 provided on the body 9, thereby preventing further rotation of the valve 10.

Moreover, since the first end portion 12 of the first spring portion 11*a* and the second end portion 13 of the second spring portion 11*b* are attached to the body 9 through the movable member 14, when the drive motor 1 becomes inoperable due to a conduction defect or the like, the joint portion 19 of the spring 11 is stopped at a position at which the torsional or twisting resilient forces of the first spring portion 11*a* and the second spring portion 11*b* become balanced with each other. That is, the valve 10 is held at a predetermined degree of intermediate opening slightly greater than an idle opening through the final spur gear 4 fixedly attached to the joint portion 19.

According to the intake air amount control apparatus as constructed above, the first end portion 12 of the first spring portion 11*a* and the second end portion 13 of the second spring portion 11*b* are attached to the body 9 through the movable member 14, and the joint portion 19 is fixedly secured to the final spur gear 4. With such an arrangement, it is possible to hold the valve 10 at the predetermined degree of intermediate opening by means of only the single spring 11, so the number of the springs as required of this embodiment can be reduced in comparison with the aforementioned known one, and at the same time the controllability of the valve 10 can be stabilized.

Further, the movable member 14 having the hooks 16, 17 at its opposite ends is fixedly attached to the body 9, and the first end portion 12 of the first spring portion 11*a* and the second end portion 13 of the second spring portion lib are engaged with the hooks 16, 17, respectively. With such an arrangement, the first end portion 12 and the second end portion 13 can be easily attached to the body 9 through the movable member 14.

Furthermore, the joint portion 19 can be easily fixed to the final spur gear 4 by using the fastening screw 21.

Besides, the first gap D is formed between the bearing surface of the first spring portion 11*a* and the body 9, and the second gap E is formed between the bearing surface of the second spring portion 11*b* and the final spur gear 4. With such an arrangement, when the final spur gear 4 is driven to rotate, the spring 11 does not make sliding contact with the body 9 and the final spur gear 4, so that the characteristic of the spring 11 can be held intact.

Further, the adjustment groove 31 extending in the rotational direction of the shaft 6 is formed in the body 9, and one end portion of the movable member 14 at the side of the hook 17 is slidably received in the adjustment groove 31. Accordingly, the degree of intermediate opening of the valve 10 can be easily adjusted by causing the movable member 14 to slide in and along the adjustment groove 31.

Embodiment 2.

Figure 9:
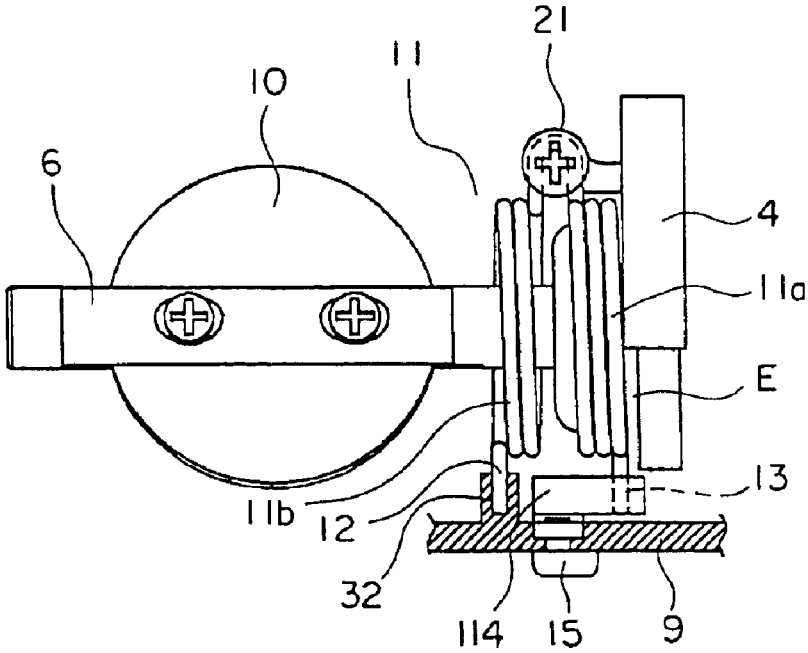
FIG. 9 is a side elevational view showing the essential portions of an intake air amount control apparatus for an engine according to a second embodiment of the present invention.
Figure 10:
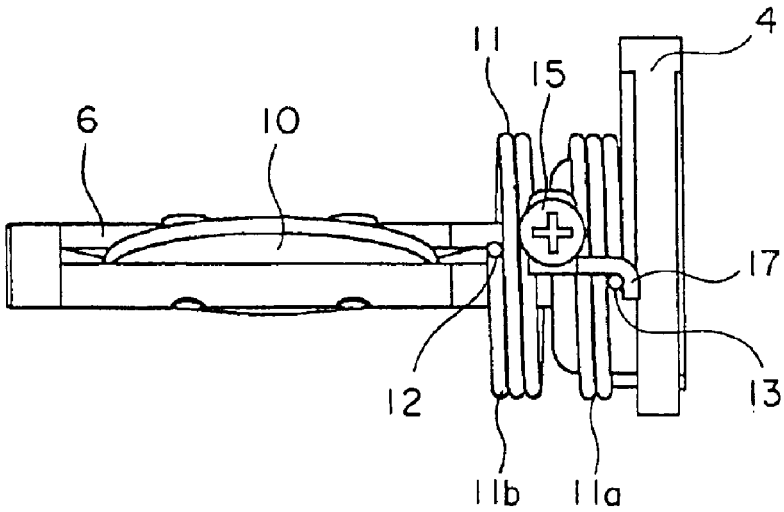
FIG. 10 is a view of the essential portions of the intake air amount control apparatus for an engine in FIG. 9 as seen from a body side.

FIG. 9 is a side elevational view that shows essential portions of an intake air amount control apparatus according to a second embodiment of the present invention. FIG. 10 is a view when FIG. 9 is seen from the body 9. Here, note that the body 9 is omitted in FIG. 10.

In the intake air amount control apparatus according to this second embodiment, a movable member 114 having a hook formed at its one end is fixedly attached to the body 9 by means of the fastening screw 15. The second end portion 13 of the second coil portion 11*b* is engaged with the hook, and the first end portion 12 of the first coil portion 11*a* is engaged with a convex portion 32 formed on the body 9.

The construction of this second embodiment other than the above is similar to that of the first embodiment.

According to the intake air amount control apparatus of this second embodiment, by causing the movable member 114 to slide along the adjustment groove 31, the second end portion 13 of the second coil portion 11*b* is displaced in the rotational direction of the shaft 6, whereby the degree of intermediate opening of the valve 10 can be easily adjusted.

Embodiment 3.

Figure 11:
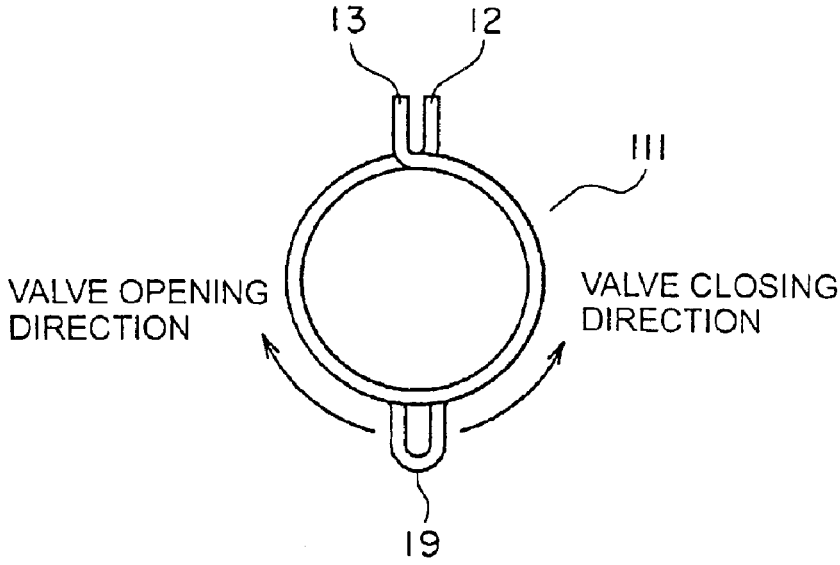
FIG. 11 is a front elevational view showing a torsion coil spring in an intake air amount control apparatus for an engine according to a third embodiment of the present invention.
Figure 12:
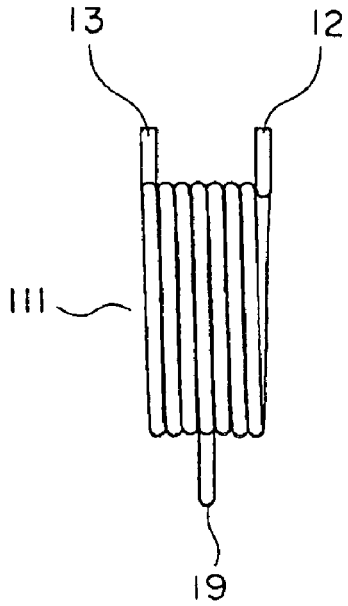
FIG. 12 is a left side elevational view showing the torsion coil spring in FIG. 11.

FIG. 11 is a front elevational view that shows a spring 111 in an intake air amount control apparatus according to a third embodiment of the present invention, and FIG. 12 is a left side elevational view that shows the spring 111 in FIG. 11.

Figure 13:
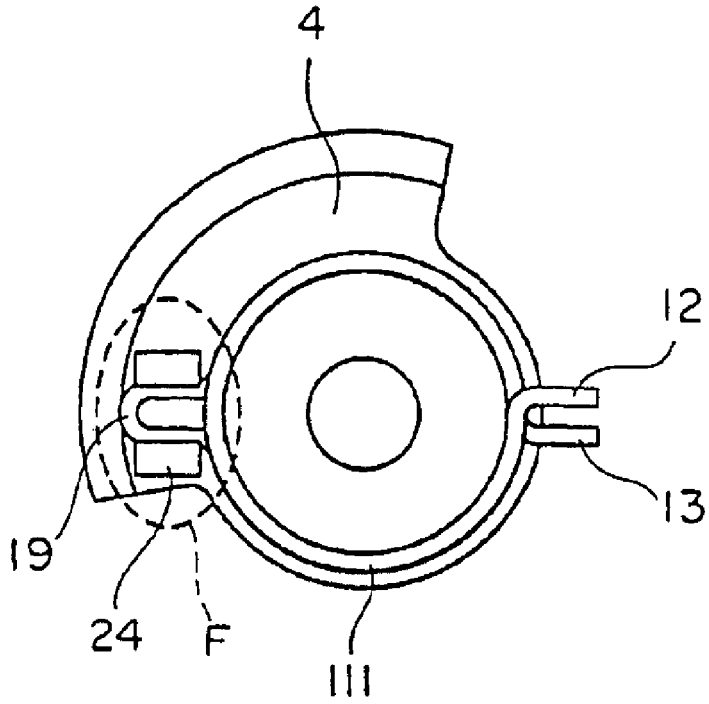
FIG. 13 is a view showing the appearance of a joint portion in FIG. 11 when mounted on a final spur gear.
Figure 14:
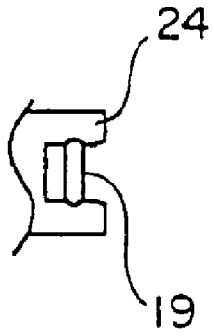
FIG. 14 is a left side elevational view of the essential portions in FIG. 13.

According to the intake air amount control apparatus of this third embodiment, the U-shaped joint portion 19 of the spring 111 is fixedly attached through press-fitting to a press-fitted portion 24 formed on the final spur gear 4, as shown in FIG. 13 and FIG. 14.

The construction of this third embodiment other than the above is similar to that of the first embodiment.

According to the intake air amount control apparatus of this third embodiment, the joint portion 19 of the spring 111 can be easily attached to the final spur gear 4 by press-fitting the joint portion 19 into the press-fitted portion 24.

Although in the above-mentioned respective embodiments, the first end portion 12 of the first coil portion 11*a* and the second end portion 13 of the second coil portion 11*b* are attached to the body 9 through the movable member 14 or 114, they may be directly attached to the body.

While the invention has been described in terms of preferred embodiments, those skilled in the art will recognize that the invention can be practiced with modifications within the spirit and scope of the appended claims.

What is claimed is:

1. An intake air amount control apparatus for an engine, comprising:

a body having an intake passage formed therein;

a shaft being disposed across said intake passage and rotatable with respect to said body;

a valve fixedly mounted on said shaft for adjusting the degree of opening in said intake passage through a rotational angle thereof;

a gear fixedly secured to said shaft for transmitting torque in a direction to open said valve from a drive motor to said shaft; and a torsion coil spring urging said valve in a direction to close said valve;

wherein said torsion coil spring includes a first spring portion having a first end portion, a second spring portion having a second end portion, a joint portion that connects said first spring portion and said second spring portion with each other, and said first end portion of said first spring portion and said second end portion of said second spring portion are attached directly or indirectly to said body, with said joint portion being attached to said gear.

2. The intake air amount control apparatus for an engine as set forth in claim 1, wherein a movable member having hooks at its opposite ends is fixedly secured to said body, and said first end portion of said first spring portion and said second end portion of said second spring portion are engaged with said hooks, respectively.

3. The intake air amount control apparatus for an engine as set forth in claim 1, wherein a movable member having a hook at its one end is fixedly secured to said body, and said first end portion of said first spring portion is engaged with said body, and said second end portion of said second spring portion is engaged with said hook.

4. The intake air amount control apparatus for an engine as set forth in claim 1, wherein said joint portion is fixedly attached to said gear by means of a fastening element.

5. The intake air amount control apparatus for an engine as set forth in claim 1, wherein said joint portion having a U-shaped configuration is attached through press-fitting into a press-fitted portion formed on said gear.

6. The intake air amount control apparatus for an engine as set forth in claim 1, wherein a first gap is formed between a bearing surface of said first spring portion and said body, and a second gap is formed between a bearing surface of said second spring portion and said gear.

7. The intake air amount control apparatus for an engine as set forth in claim 2, wherein an adjustment groove extending in a rotational direction of said shaft is formed in said body, and said movable member has its one end slidably received in and along said adjustment groove.

8. The intake air amount control apparatus for an engine as set forth in claim 3, wherein an adjustment groove extending in a rotational direction of said shaft is formed in said body, and said movable member has its one end slidably received in and along said adjustment groove.

* * * * *